US007207459B1

(12) United States Patent
Latvis et al.

(10) Patent No.: US 7,207,459 B1
(45) Date of Patent: Apr. 24, 2007

(54) PLATTER ENSEMBLE

(76) Inventors: William J. Latvis, 10778 Green Trail Dr., Pine Tree Village South, Boynton Beach, FL (US) 33436; T. J. Lats Latvis, 2552-A Gough St., San Francisco, CA (US) 94123

( * ) Notice: Subject to any disclaimer, the term of this patent is extended or adjusted under 35 U.S.C. 154(b) by 0 days.

(21) Appl. No.: 11/262,428

(22) Filed: Oct. 31, 2005

(51) Int. Cl.
*A47G 19/00* (2006.01)

(52) U.S. Cl. ..... 220/574; 220/575; 220/574.3

(58) Field of Classification Search ..... 220/574, 220/575, 574.3, 574.1
See application file for complete search history.

(56) References Cited

U.S. PATENT DOCUMENTS 2,650,485 A * 9/1953 La Greca ..... 220/23.83
4,147,277 A * 4/1979 Bateman et al. ..... 220/574.2
5,871,116 A * 2/1999 Picchietti ..... 220/501
7,025,213 B2 * 4/2006 Chen ..... 210/474
2005/0120891 A1 * 6/2005 Morgan ..... 99/426
* cited by examiner

*Primary Examiner*—Anthony D. Stashick
*Assistant Examiner*—Shawn M. Braden
(74) *Attorney, Agent, or Firm*—John E. Bargero

(57) ABSTRACT

The present invention discloses a platter ensemble that has two platters inter nested or stack, so that they appear as one unit. The upper platter has a large recessed area to hold the foodstuff, such as lobster or other shellfish. This recessed area has slots or holes to allow for the drainage of the liquid from the foodstuff, which is then contained by the lower platter. The upper platter has a supporting system of continuous tabs or stand offs that contact and separate the upper platter from the lower platter, so as to prevent deflection of the upper platter from the weight of the foodstuff or the pressures exerted by a fork or knife, for example. The upper platter also has a smaller recessed reservoir area to hold sauces, melted butter, or similar items.

The lower platter has one continuous recessed area that is deeper and slightly larger than the upper platter to allow for inter nesting, stacking, and the containment of the liquid that has drained from the foodstuff. Additionally, the lower platter has two semi-circular cut outs to accommodate a finger or thumb allowing for easier separation of the ensemble.

2 Claims, 6 Drawing Sheets

PLATTER ENSEMBLE

BACKGROUND OF THE INVENTION

This invention relates to a food platter for the service and presentation of food, more specifically food that contains liquids, such as lobster, crab, steamed shellfish, and many other types of food. The fundamental concept is to insure that the food is separated from the liquid and or juices it exudes, which would adversely affect the taste and texture of the food. The platter can also be used for displaying juicy or liquid containing foodstuffs, such as poultry and raw meats wherein contact with the liquid, in this case blood, may cause accelerated spoilage.

The invention is ideal for the service of seafoods such as lobster because it allows for an attractive display of the lobster and side dishes, and provides the function of preventing the juices from mingling. The small reservoir within the top platter is ideal for the storage of melted butter, cocktail sauce, or other sauces for dipping. The top platter is designed to withstand forces applied by a fork or knife and/or exerted pressure caused by the user bearing down on the top platter. Since the two platters are separable, it allows for easier cleaning, that is the lower platter will only contain liquid and not food particles and so easily cleaned. Moreover, the lower platter portion can be used alone for other food types as a stand-alone platter. This feature is desirable in locations where storage is limited, such as in restaurants and where economy of use is desired.

There are several variations of the concept of separating liquid exuding products from their source; however, their focus has been on that of packaging for distribution, such as in the meat, fish and poultry industry. One of the distinguishing factors of this invention is that it has the primary intent to be used for the service of prepared foods, such as in restaurants or for the consumer in home settings.

The invention allows for the attractive, yet practical service of food in a manner that prevents the commingling of the food's juices, while keeping the foods from being soaked in their juices, a fundamental drawback of compartmental trays used in cafeteria settings.

SUMMARY OF THE INVENTION

The present invention discloses a novel food service platter ensemble that combines two trays, an upper or inner platter and a lower or outer platter that are stacked to form one integrated platter. The term tray and platter are interchangeable, but for the sake of clarity, the term platter will be used throughout.

The lower platter has a base wall and sidewalls that extend up from the base wall to form a cavity therein. A shoulder area raised from and completely surrounding the base wall is attached to the end of the sidewalls. The base wall can be a myriad of shapes, such as oval, round, rectangular, triangular or any combination of these shapes. The shouldered area has at least two notches that can accommodate a thumb or finger, allowing for easy separation of the two platters.

The upper platter has a base wall and sidewalls that extend up from the base wall to form a cavity therein. The cavity formed is slightly smaller than that of the lower platter to allow for the nesting or stacking of the platters and to contain the liquid. The smaller upper platter has a base wall that is of a lesser area than the lower platter base wall and sidewalls that are shorter in length than that of the lower platter. A shoulder area, raised from and completely surrounding the base wall is attached to the end of the sidewalls.

The base wall is of the same shape as the lower platter. In one embodiment the cavity formed by base wall and the sidewalls is further divided by at least one more sidewall that extends up from the base wall to form another smaller cavity, suitable for sauces, rinse water or melted butter.

The upper platter base wall that comprises the larger cavity has perforations or slots that allow the liquid to pass through into the lower platter. The upper platter base wall has stand off tabs that extend from the underside of the upper platter base wall towards the lower platter's base wall top surface and is in contact with that surface when the two platters are assembled.

In one embodiment the stand off tabs are a series of cylindrical members or rings that extend downwards from the upper platter base wall towards the top surface of the lower platter base wall forming a spacer between the two platters. The cylindrical members have portions removed to allow for free flow of the liquid within the lower platter.

These and other objects, advantages, purposes and features of the invention will become more apparent from the study of the following description taken in conjunction with the drawings.

DETAILED DESCRIPTION OF THE DRAWINGS

DETAILED DESCRIPTION OF THE DRAWINGS AND PREFERRED EMBODIMENTS

While describing the invention and its embodiments, various terms will be used for the sake of clarity. These terms are intended to not only include the recited embodiments, but also all equivalents that perform substantially the same function, in substantially the same manner to achieve the same result.

Figure 1:
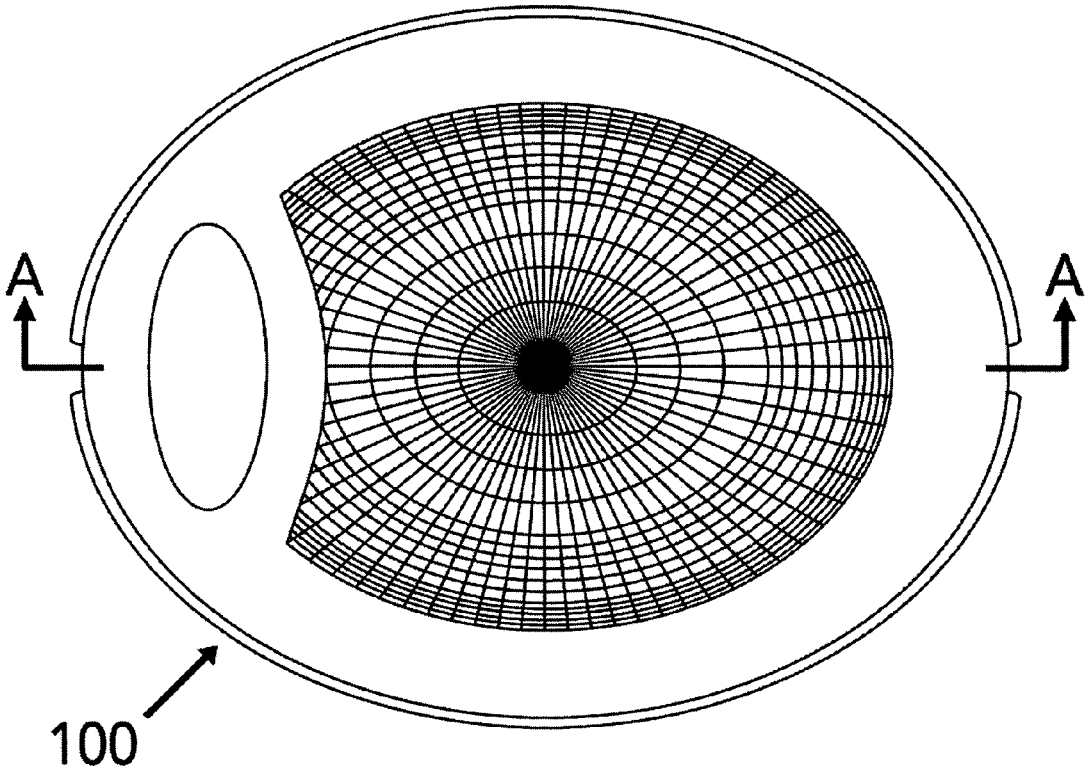
FIG. 1 is a top plan view of the platter ensemble.
Figure 2:
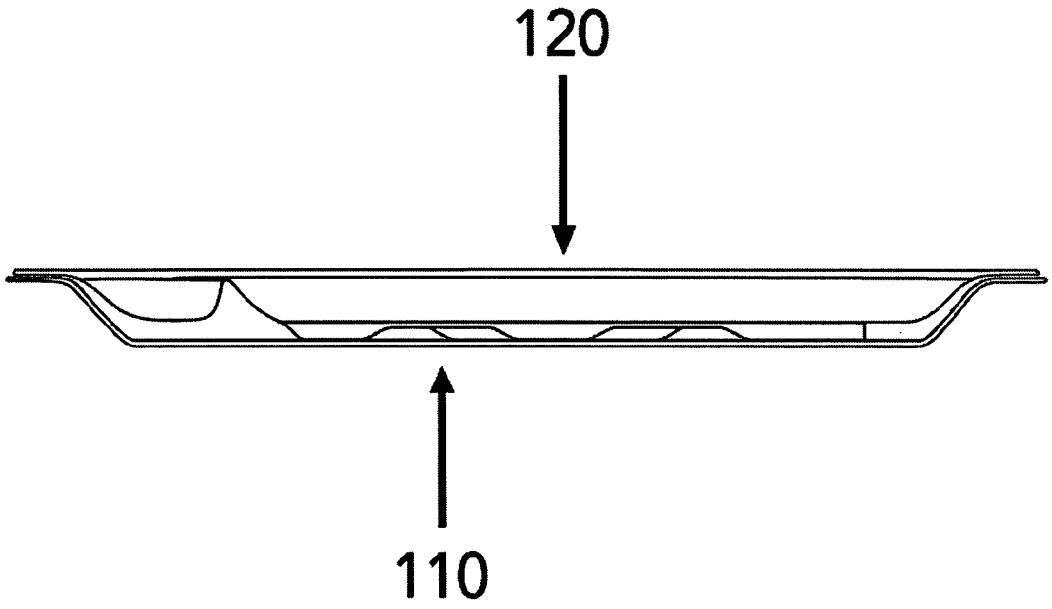
FIG. 2 is a cross-sectional view of the platter ensemble taken along line a—a of FIG. 1.

A preferred embodiment of the present invention discloses a platter ensemble shown as in a top plan view in FIG. 1 and indicated generally by reference numeral 100, is comprised of an upper platter 120 and a lower platter 110 as depicted in FIG. 2. The platter ensemble 100 is preferably formed from a rigid material, such as plastic, porcelain, glass, paper or ceramic. The platter ensemble can be of virtually any shape that is; circular, square, triangular, hexagonal, oval or any other combination of these shapes. The preferred embodiment disclosed is oval shaped.

Figure 3:
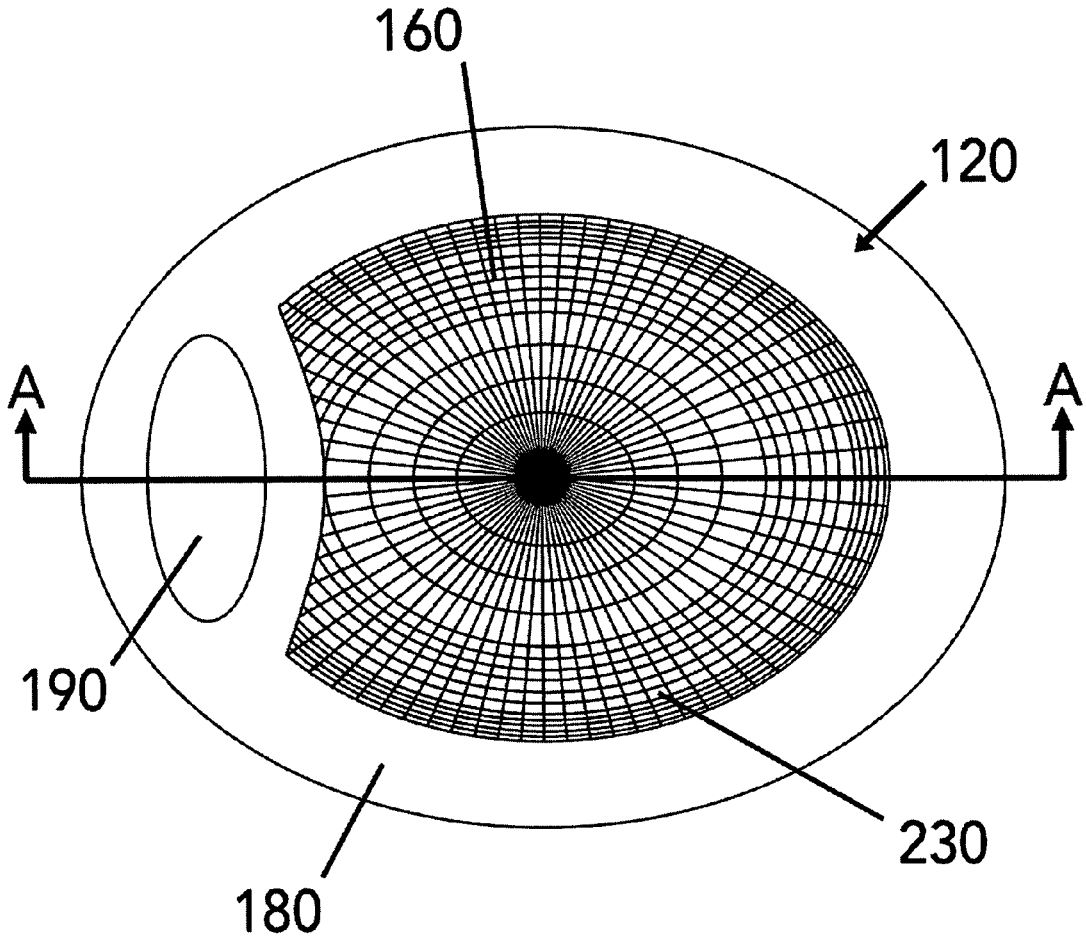
FIG. 3 is a top plan view of the upper platter.
Figure 4:
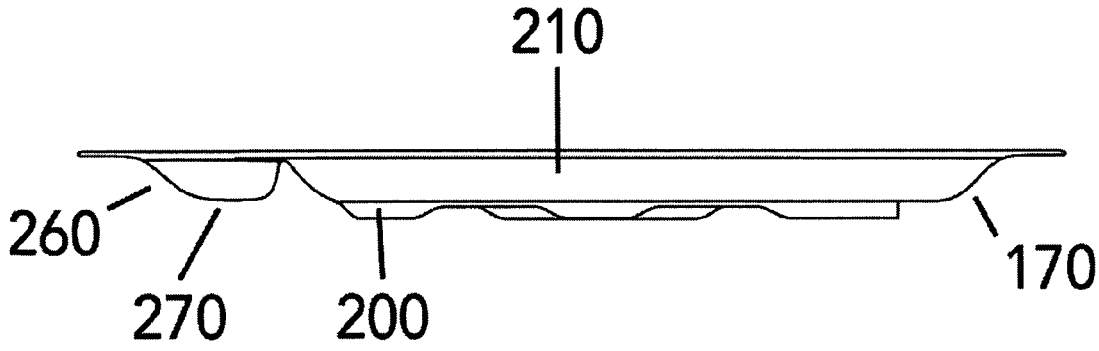
FIG. 4 is a cross sectional view of upper platter taken along line a—a of FIG. 3.

Referring to FIG. 3 and FIG. 4, upper platter 120 includes a base wall 160 and at least one sidewall 170 that forms a continuous perimeter wall that extends around and upwardly from base wall 160 to thereby form a cavity 210, the sidewall 170 may be planar or concave. The base wall 160 includes a plurality of slots 230 that radiate from and away from the center of the tray towards the sidewall 170 in a hub and spoke fashion to allow for drainage, other embodiments contemplate a plurality small holes instead of slots 230 for drainage.

Extending from and downwardly from the bottom of the upper platter base wall 160 is a series of tabs 200 that are of adequate length that when the upper platter 120 is inserted into the lower platter 110, the tabs 200 contact the upper surface of the lower platter base wall 130. These tabs 200 provide support and rigidity to the upper platter 120 and can be a variety of configurations, the preferred embodiment comprises a series of concentric semicircular tabs staggered to allow for the free flow of fluid in the lower platter 110, while providing additional strength and rigidity to the upper platter 120 to resist forces generated by the weight of the food or by the user bearing down on the top platter or by the use of utensils, such as knives and forks.

In a preferred embodiment there is at least one additional small cavity 190 that proceeds downwardly from the upper platter shoulder 180 that has a base wall 270 and at least one sidewall 260, that may be planar or concave, that forms a continuous perimeter wall that extends around and upwardly from the small cavity base wall 270 terminating at the upper platter shoulder area 180 and is suitable for containing melted butter, sauces or other liquids. The small cavity 190 would occupy, at most, less than half of the volume of the upper platter 120.

Figure 5:
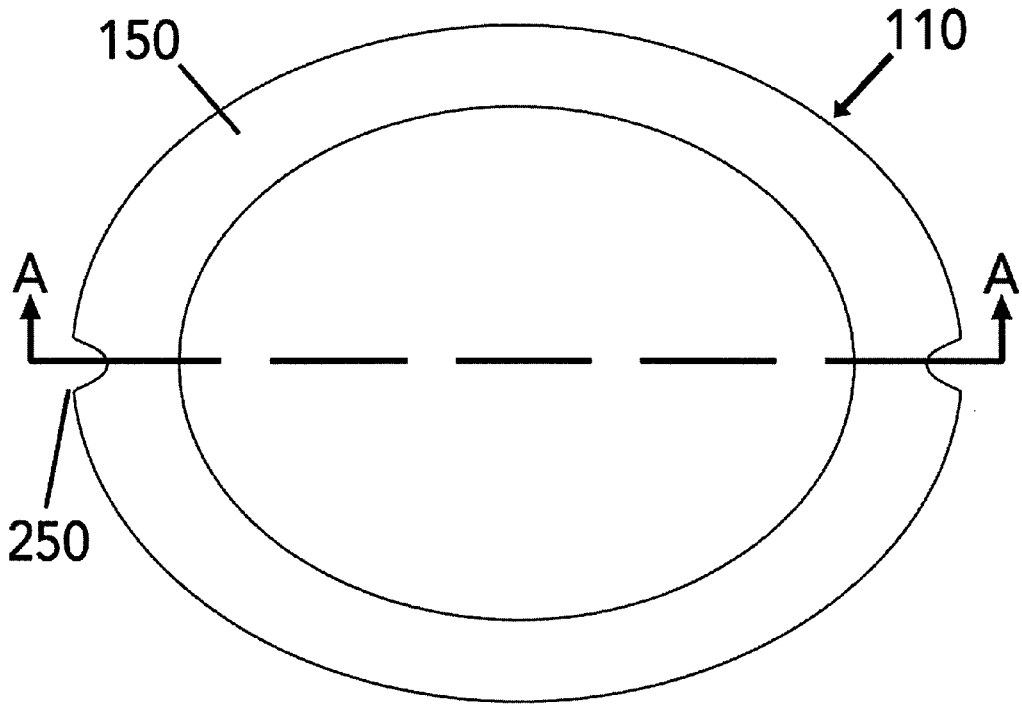
FIG. 5 is a top plan view of the lower platter.
Figure 6:
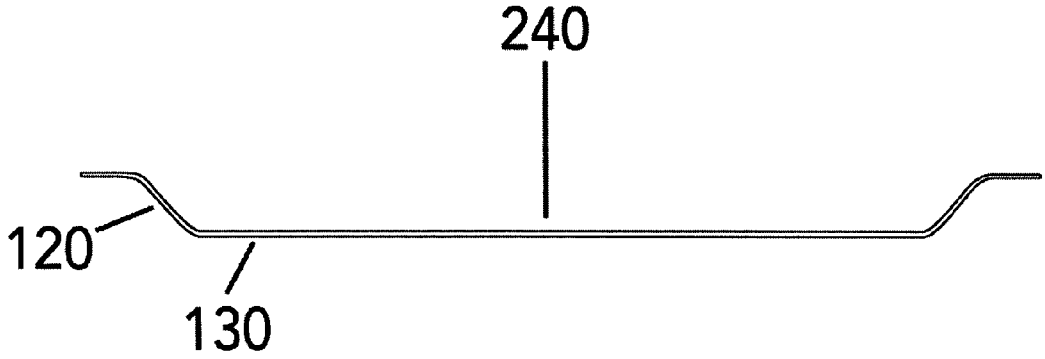
FIG. 6 is a cross sectional view of the lower platter taken along line a—a of FIG. 5.

Referring to FIG. 5 and FIG. 6, lower platter 110 includes a base wall 130 that encompasses a slightly larger area than the upper platter base wall 160 and at least one sidewall 170, that may be planar or concave, that forms a continuous perimeter wall that extends around and upwardly from base wall 130 of a greater length than the upper platter sidewall 170 to thereby form a cavity 240 which is larger than the upper platter cavity 210 to allow for the containment of liquid in the lower platter 110 and the insertion of the upper platter 120 into the lower platter 110 to form the platter ensemble 100. A shoulder area 150 raised from and completely surrounding said side walls 120 said shoulder area 150 has at least two semicircular notches 250 to allow for insertion of fingers or thumbs for easy separation of the lower platter 110 from the upper platter 120.

The invention has been described in terms of the preferred embodiment. One skilled in the art will recognize that it would be possible to construct the elements of the present invention from a variety of means and to modify the placement of the components in a variety of ways, such as varying the shapes of the platter ensemble from oval to square or any other configuration, just as the shape, quantity, and location of the smaller containment area. While the embodiments of the invention have been described in detail and shown in the accompanying drawings, it will be evident that various further modifications are possible without departing from the scope of the invention as set forth in the following claims.

What is claimed is:

1. A platter ensemble for serving liquid exuding foods, comprising; a lower platter and an upper platter fitting therein, said lower platter having a flat base wall, concave side walls, a shoulder area raised from and completely surrounding said concave side walls, said shoulder having at least one semicircular notched section roughly the width of a human thumb removed from said shoulder, said upper platter having a base wall with support tabs extending toward the upper surface of the lower platter flat base, concave side walls, shoulder area raised from and completely surrounding the perimeter of said concave side walls, said upper platter flat base being slotted or perforated, said upper shaped platter is of slightly smaller dimensions than said lower shaped platter to allow nesting of the two the upper platter has a small cavity proceeding downwardly form the upper platter shoulder, with a solid base wall, at least one sidewall terminating at the upper platter shoulder area forming at least two distinct serving areas.

2. A platter ensemble for serving liquid exuding foods, comprising; a lower platter and an upper platter fitting therein, said lower platter having a flat base wall, concave side walls, a shoulder area raised from and completely surrounding said concave side walls, said shoulder having at least one semicircular notched sections roughly the width of a human thumb removed from said shoulder, said upper platter having a base wall with support tabs extending toward the upper surface of the lower platter flat base, concave side walls, shoulder area raised from and completely surrounding the perimeter of said concave side walls, at least one wall connecting and dividing said side walls forming at least two separate food serving areas, said upper platter flat base being slotted or perforated in only one food serving area, said upper shaped platter is of slightly smaller dimensions than said lower shaped platter to allow nesting of the two.

* * * * *